US012000595B2

(12) United States Patent
Dadoyan

(10) Patent No.: US 12,000,595 B2
(45) Date of Patent: Jun. 4, 2024

(54) HEATER DIRECTIONAL REFLECTORS

(71) Applicant: David Dadoyan, Valley Glen, CA (US)

(72) Inventor: David Dadoyan, Valley Glen, CA (US)

( * ) Notice: Subject to any disclaimer, the term of this patent is extended or adjusted under 35 U.S.C. 154(b) by 232 days.

(21) Appl. No.: 17/581,786

(22) Filed: Jan. 21, 2022

(65) Prior Publication Data

US 2022/0228755 A1 Jul. 21, 2022

Related U.S. Application Data

(60) Provisional application No. 63/199,738, filed on Jan. 21, 2021.

(51) Int. Cl.
*F24C 15/22* (2006.01)
*F24C 15/00* (2006.01)

(52) U.S. Cl.
CPC ..... *F24C 15/22* (2013.01); *F24C 15/007* (2013.01)

(58) Field of Classification Search
CPC .... F24C 1/10; F24C 1/12; F24C 15/22; F24C 15/007
See application file for complete search history.

(56) References Cited

U.S. PATENT DOCUMENTS

2021/0140649 A1* 5/2021 Dadoyan ..... F24C 1/12

* cited by examiner

*Primary Examiner* — David J Laux
(74) *Attorney, Agent, or Firm* — Foundation Law Group LLP; Sevag Demirjian; J D Harriman

(57) ABSTRACT

The present apparatus is a heat focusing reflector that can either be built in by the manufacturer of the heater or an add-on attachment that can be installed by an end user to allow these types of heaters to project more heat to further distances. The heat focusing reflector will block heat from traveling all around these types of heater and will instead focus and/or reflect all of the heat to travel toward one side of the heater. By redirecting heat from these heaters and focusing the heat to travel longer distances away from the heater, these heaters can become more efficient and functional as an outdoor space heater.

4 Claims, 29 Drawing Sheets

HEATER DIRECTIONAL REFLECTORS

This patent application claims priority to U.S. Provisional Patent Application 63/199,738 filed on Jan. 21, 2021, which is incorporated by reference herein in its entirety.

BACKGROUND OF THE SYSTEM

The present apparatus relates to space heaters and, more particularly, a heater directional reflector for improving space heaters such as column flame patio heaters.

Column flame or vortex patio and/or table-top heaters come in a variety of shapes, styles and sizes. Some are made with four corners and resemble a pyramid shape with a wide base and a narrowing profile toward the top, others have three sides and also narrow toward the top. There are also column heaters that are round, cylinder like structures. Some are very large and tall while others are small enough to fit on top of patio table. These patio heaters are typically identifiable by a flame column, which adds ambiance to an outdoor setting while also helping to warm the space for added comfort. While these heaters are generally pleasing to look at, they all suffer from a critical design flaw. The fail to radiate a useful level of heat to any distance beyond their immediate surroundings.

Column flame designs are most effective when placed in the middle of the environment to be heated. The designs emit heat in a circle with the device at the center. However, there are some situations where the heater must be placed at an edge of an environment, or only on one side of where people will be located. In those conditions, the heaters are not efficient because much of the heat is emitted into unoccupied space. One solution to that problem is to use a more powerful heater so that enough heat is provided to the occupied spaces. The alternative is to have inadequate heating in the occupied area.

SUMMARY

The present apparatus improves on the existing designs for pyramid, vortex or column flame type patio heaters because it allows a user to modify the shape and direction of the heat output by the heater. Thus, when desired, the heater output may be left at 360 degrees or selectively modified and focused down to a pattern that is narrower. A wider pattern closer to 360 degrees will result in a shorter range of maximum heat while a narrower pattern such as 180 degrees will result in higher temperatures in the pattern range and more efficient heater operation.

The present apparatus is a heat focusing reflector that can either be built in by the manufacturer of the heater or an add-on attachment that can be installed by an end user to allow these types of heaters to project more heat to further distances. The heat focusing reflector will block heat from traveling all around these types of heater and will instead focus and/or reflect all of the heat to travel toward one side of the heater. By redirecting heat from these heaters and focusing the heat to travel longer distances away from the heater, these heaters can become more efficient and functional as an outdoor space heater. In addition to directing heat, the reflective surfaces will also reflect the light from the flames that are emitted by the outdoor heater thereby increasing the ambiance and visual output of the heater which would make it more pleasing to look at as well.

DETAILED DESCRIPTION OF THE SYSTEM

The present device provides a way for a pyramid type heater to direct and reflect radiant and/or convective heat in a desired direction, and to reduce or prevent the flow of heat in another direction. This allows the same amount of heat to be provided with less fuel, or to provide more heat with the same fuel, as well as various other combinations.

Figure 1:
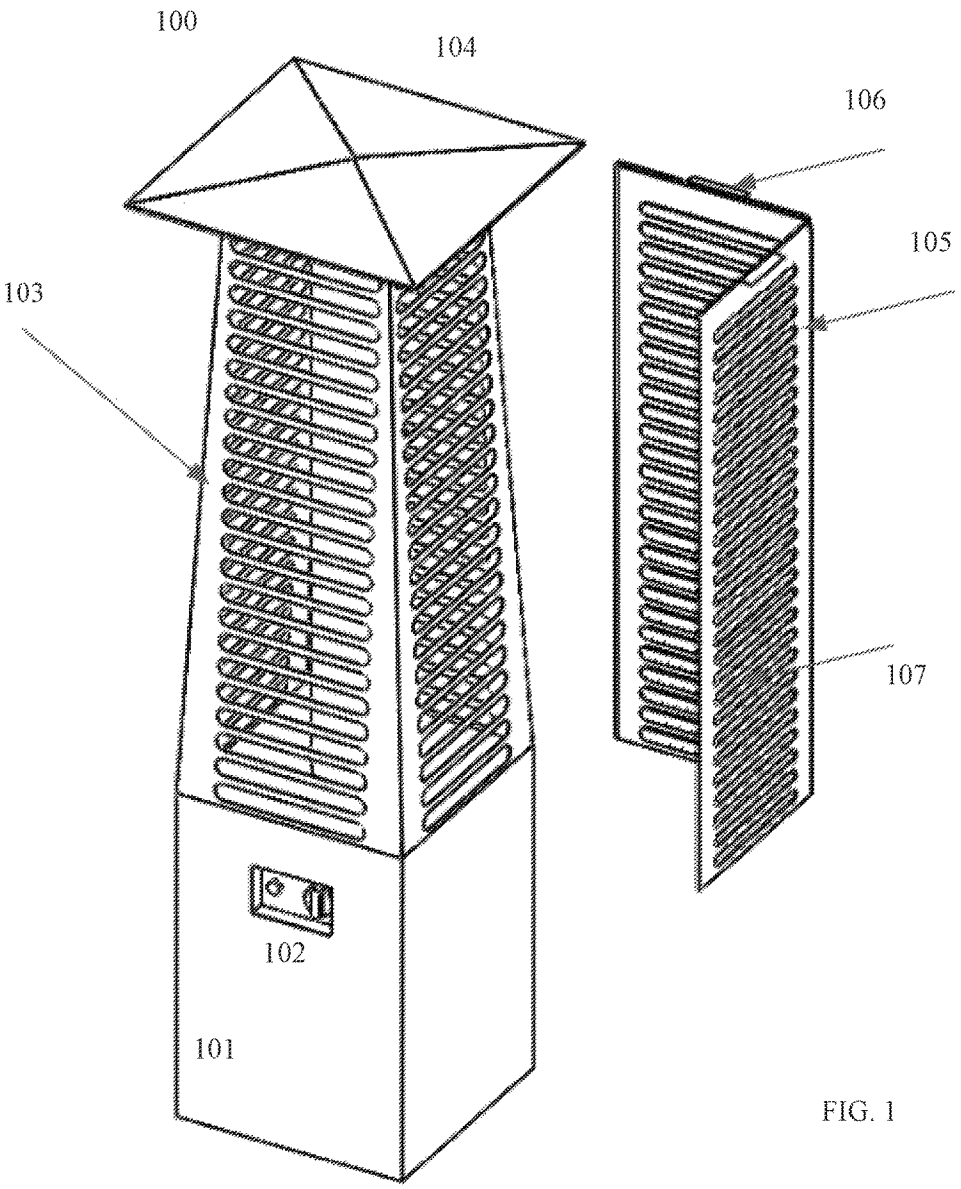
FIG. 1 is an embodiment of the apparatus with hinged panels.

FIG. 1 illustrates a directional heat shield for use with a vortex or pyramid style heater. A vortex or pyramid flame style heater 100 comprises a base 101, control unit 102, pyramid structure 103, and reflector cap 104. The fuel source (e.g., propane) is kept in the base 101 and is activated and ignited via control unit 102. The fuel is emitted into a clear tube (e.g., glass, not shown) that extends through the middle of the pyramid structure 103. The heater 100 is topped by a reflector cap 104. In operation, a flame extends through some or all of the length of the glass tube when lit, providing heat that is radiated away from the heater in all directions.

Vortex or pyramid type heaters are known for poor performance when compared to round heaters because much of the heat radiance is traded for the aesthetic appeal of the open and visible flame. In one embodiment, a one, two, or three panel directional heat shield 105 is provided that matches the dimensions of the side walls of the pyramid structure 103. In one embodiment, the heat shield 105 includes open slits 107 and fasteners 106. The heat shield 105 may be attached to the edge of the cap 104 in one embodiment. In one embodiment, the heat shield 105 may be coupled to the heater 100 directly overlaying the sides of the pyramid structure 103. The use of the heat shield 105 can improve the heating performance of the vortex heater 100 such that it can approximate the ability of a round heater.

Figure 2:
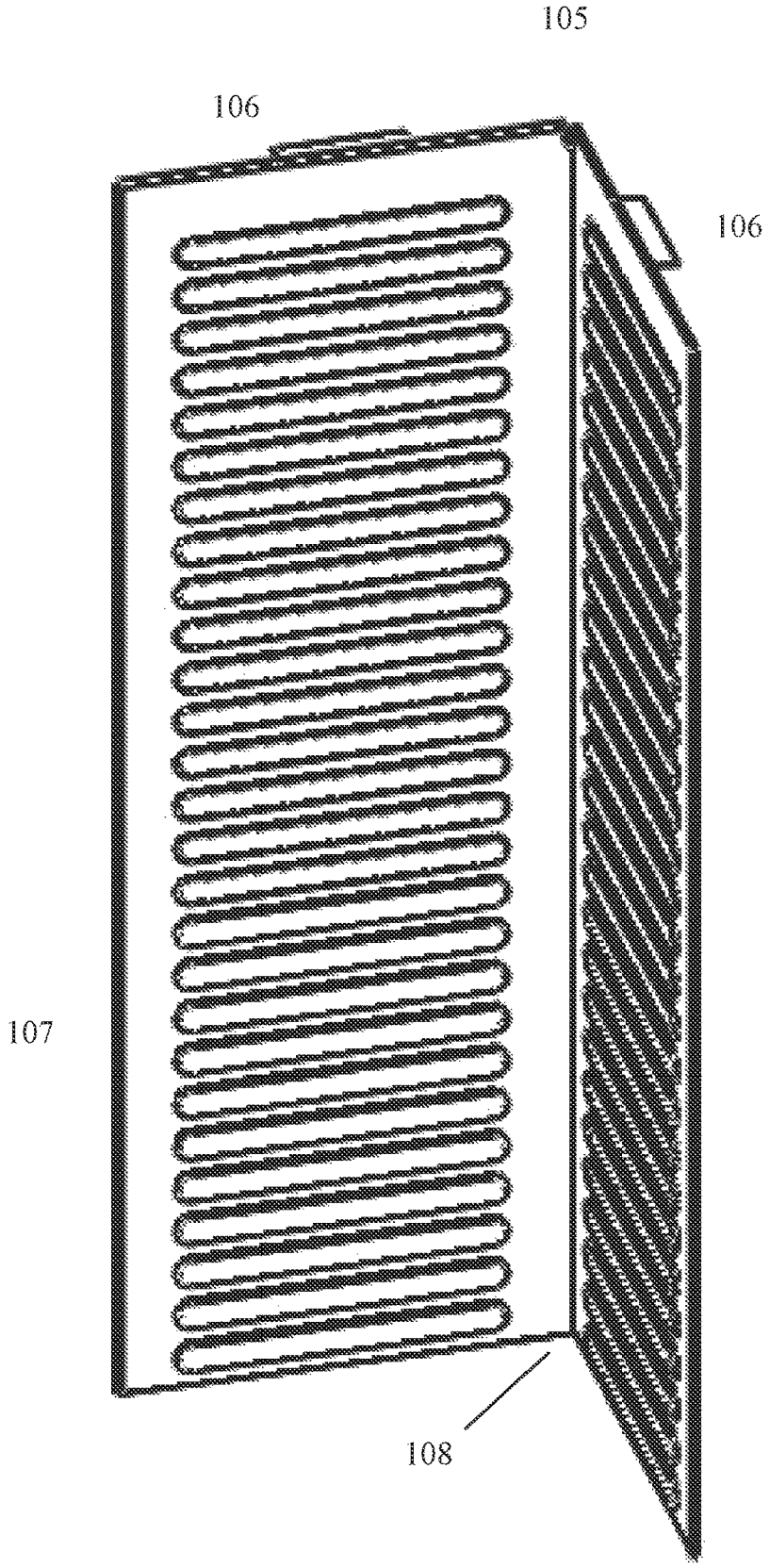
FIG. 2 is a detailed view of the panel of FIG. 1.

FIG. 2 illustrates the directional heat shield 105 of FIG. 1. The heat shield 105 may be flat or it may have open slits 107. It may be individual panels shaped like each side of the pyramid structure or it may be a pair of panels joined by hinge 108. The panels may be metal or heat resistant fabric as desired. The panels may be soft or rigid. The open slits 107 may be provided along the surface of each reflective plate to allow wind to pass through the reflective plates 105 to reduce any risk of having the heater tip over due to increase wind drag of the reflective plates. In one embodiment, instead of open slits, the elements could be convex ribs that help focus the heat back toward the open area of the heater.

Figure 5:
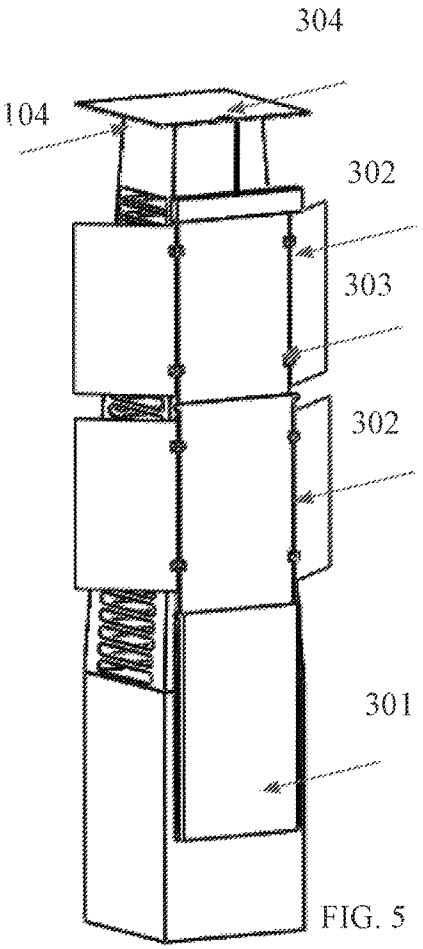
FIG. 5 illustrates the embodiment of FIG. 4 with side panels deployed.
Figure 4:
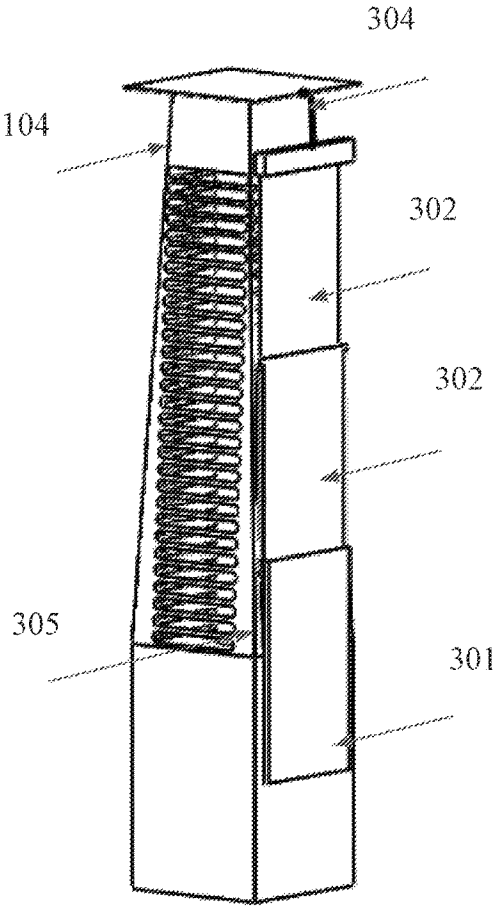
FIG. 4 illustrates the embodiment of FIG. 3 in an open configuration.
Figure 3:
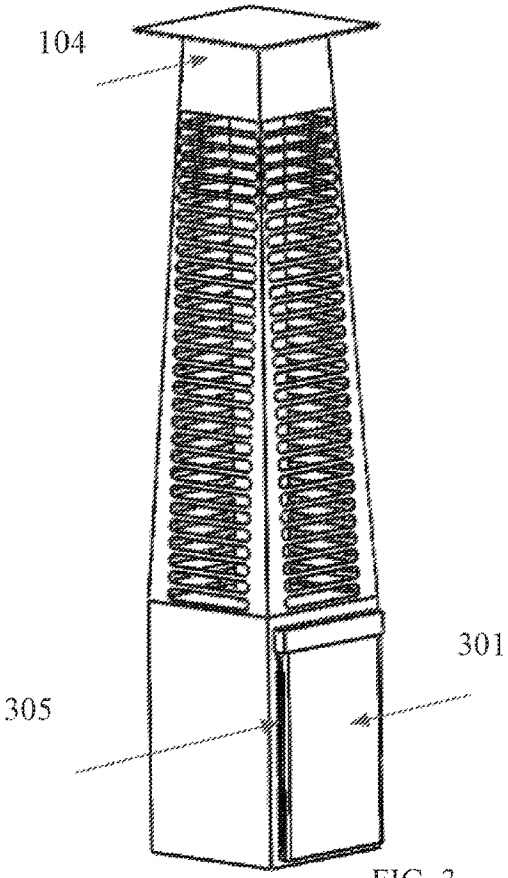
FIG. 3 illustrates an embodiment of the apparatus in a closed configuration.

FIGS. 3, 4, and 5 illustrate an embodiment of the system where the reflector is comprised of telescoping shingle like members that unfold on one, two, or three sides of the heater to provide customizable directional heating. FIG. 3 illustrates a heater with a cap 104 and a telescoping mechanism 305 in housing 301 that allows multiple reflector plates 302 to be stored easily on the heater when not in use.

As seen in FIG. 4, the plates 302 telescope upwardly from optional housing 301 using the telescoping mechanism 305 which may be similar to nested sliding doors, for example. The top plate 302 can have a mechanism to engage fastener 304 on the top of cap 104. The fastener may be mechanical, magnetic, or the like. The fastener may include an angle adjustment mechanism to allow the reflectors to swing and let wind pass through.

As shown in FIG. 5, each plate 302 may comprise additional plates coupled by hinges such as hinge 303. This allows the telescoping plates to cover one, two, or three sides of the heater, to focus the direction of the heat as desired in a multiple of customizable configurations. The panels may be soft or rigid and can be single shingle like units or can be sets of two or more folding reflective surfaces as shown. The panels may include small open slits formed in such a way to permit heat reflection while still allowing wind to pass through.

Figure 6:
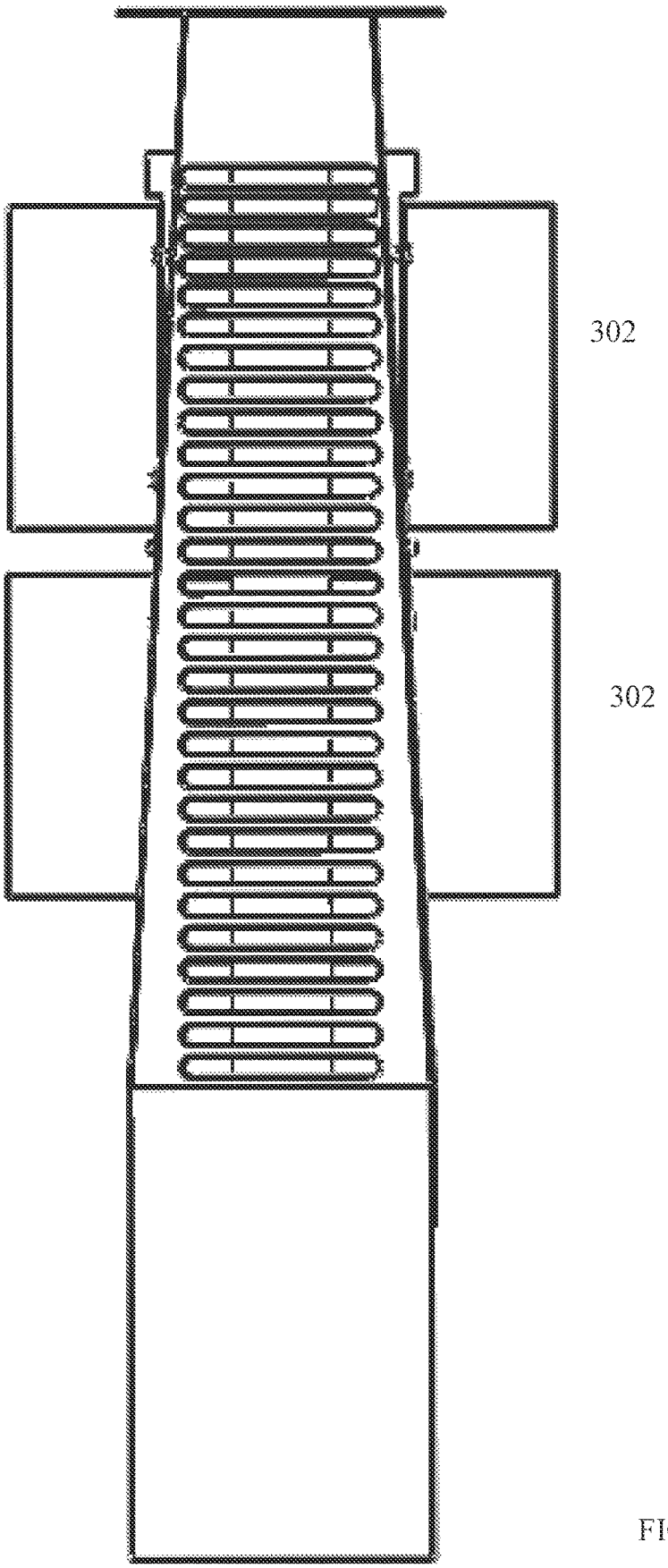
FIG. 6 is a front view of the embodiment of FIG. 5.

FIG. 6 illustrates a view of the plates 302 from the front. The hinged plates may be used to provide a wider reflecting surface as shown in FIG. 6, or they may be folded against the sides of the heater to further concentrate the heat reflection in one direction.

One embodiment of the present apparatus includes two or three reflective panels that are hinged together and hung from one side of a column flame patio heater. When the hinged plates are expanded, the reflective surface on one side of the heater is greatly increased. A large amount of heat that is being outputted by the heater is then deflected and redirected toward only one half of the heater. The concentrated heat output results in more heat and a longer range of heat which is all directed toward the side of the heater that is opposite to the reflector.

One variant of this reflector apparatus may be produced using aluminium or steel sheet metal. Softer, heat resistant, reflective fabrics may also be used to achieve the same result. The heat reflective heat shield may be produced in a number of ways. Rigid reflective surfaces may be hinged or fastened together and propped up, hung from or fastened to an outdoor column flame type patio heater to direct and focus the heat being produced by the heater. The hinges, fasteners, panel angle adjustment, scratch prevention, wind pass, and housing mechanism are optional.

Figure 9:
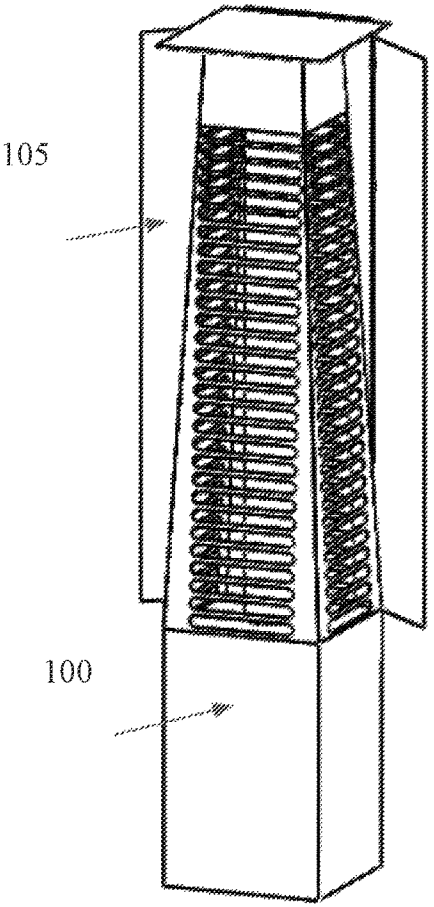
FIG. 9 illustrates the embodiment of FIG. 8 in a front view.
Figure 8:
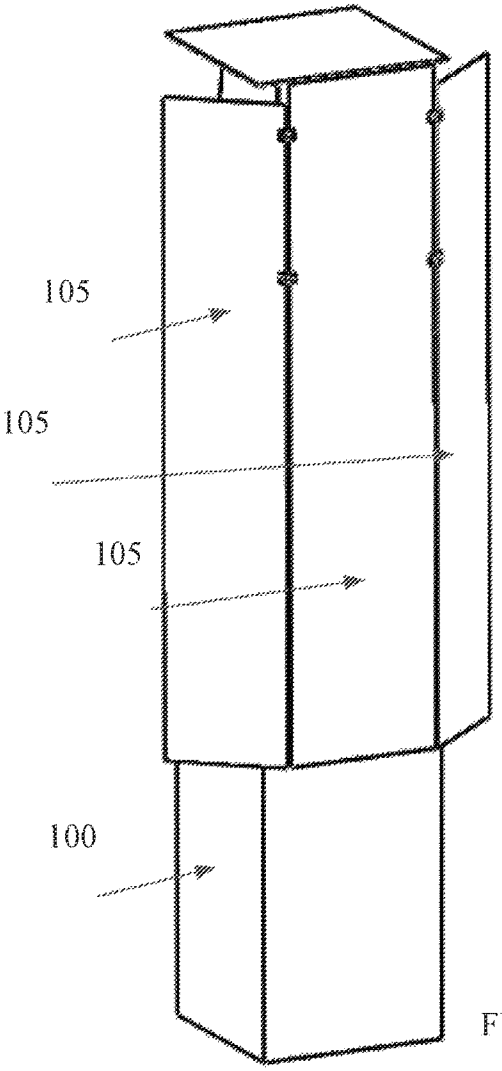
FIG. 8 illustrates the embodiment of FIG. 7 in an open configuration from a rear view.
Figure 7:
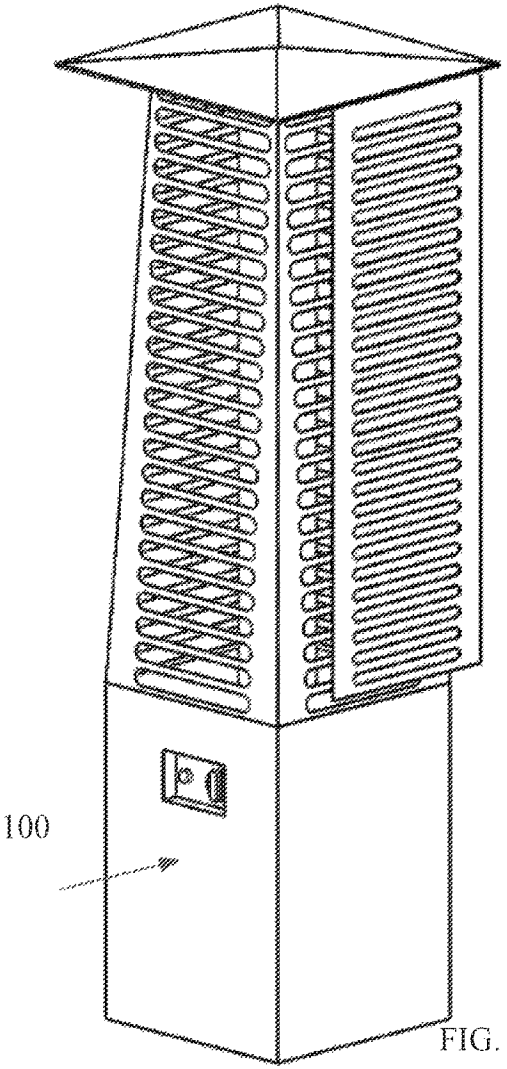
FIG. 7 illustrates a rear view of an embodiment of the apparatus.

FIGS. 7, 8, and 9 illustrate an embodiment of the apparatus. FIG. 7 illustrates a heater 100 with a panel attached to one of the four sides. As shown in a rear view in FIG. 8, the panel may have two additional panels 105 hingedly coupled to the first panel 105. These panels may fold down on the back of the center panel and then be swung out to change the reflective effect of the apparatus. FIG. 9 illustrates a front view of the panel with these side panels helping direct additional heat to one side of the heater 100. The user can have more heat directed to one area using the same amount of fuel. Alternatively, the user can use less fuel to provide the same amount of heat due to the directing of formerly wasted heat in a directional manner.

Additionally, the present apparatus can be used at different applications where directing heat or light is desired. For example, the user can place this apparatus next to a gas fire pit to redirect the heat from that fire pit toward one side of the fire pit.

Figure 10:
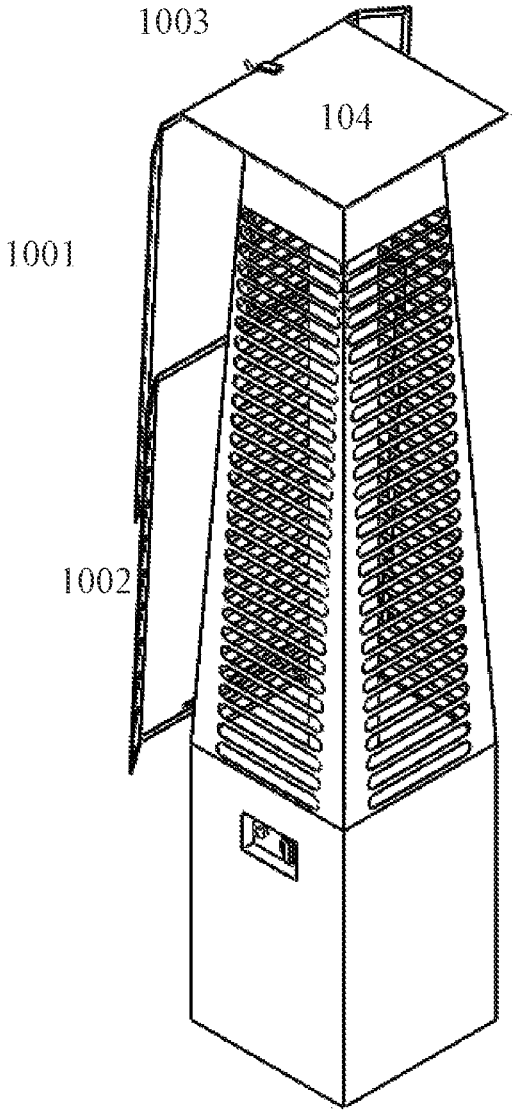
FIG. 10 illustrates an embodiment of the apparatus coupled to a cap of a heater.
Figure 11:
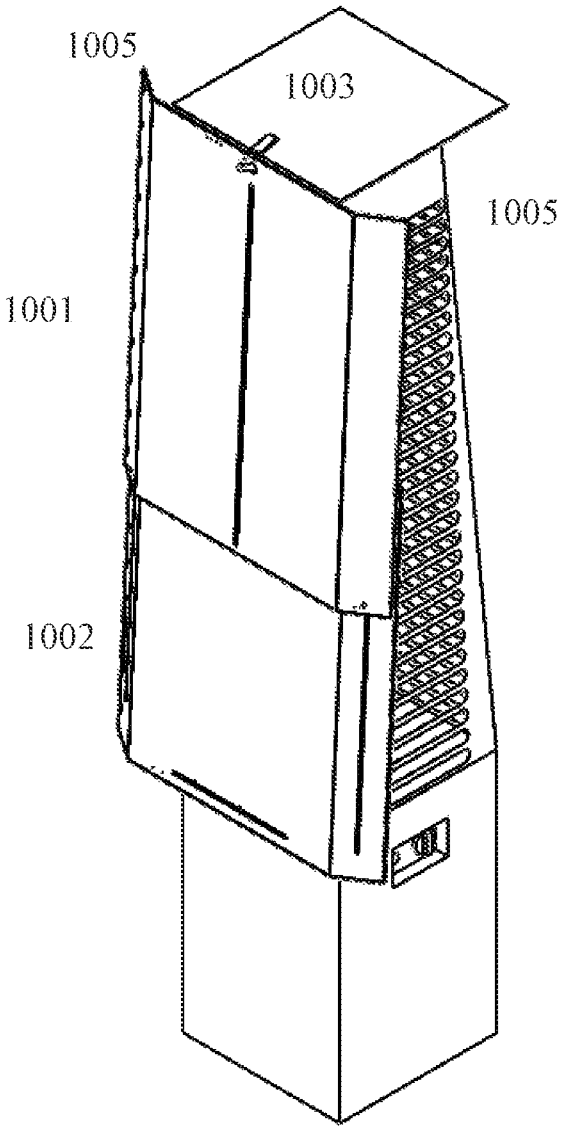
FIG. 11 is a rear view of the embodiment of FIG. 10.

FIG. 10 illustrates an alternate embodiment of the apparatus. Here the panels 1001 and 1002 are affixed to the heater cap 104 via fastener 1003. The panels are wider than the sides of the heater and allow for greater reflection of light and heat by the reflector panels. The panels 1001 and 1002 can slide together in openings on the edge to reduce their size for storage and transportation. As seen in rear view FIG. 11, the panels have short "wings" 1004 on either side that are turned in slightly to direct heat in the desired direction.

Figure 12:
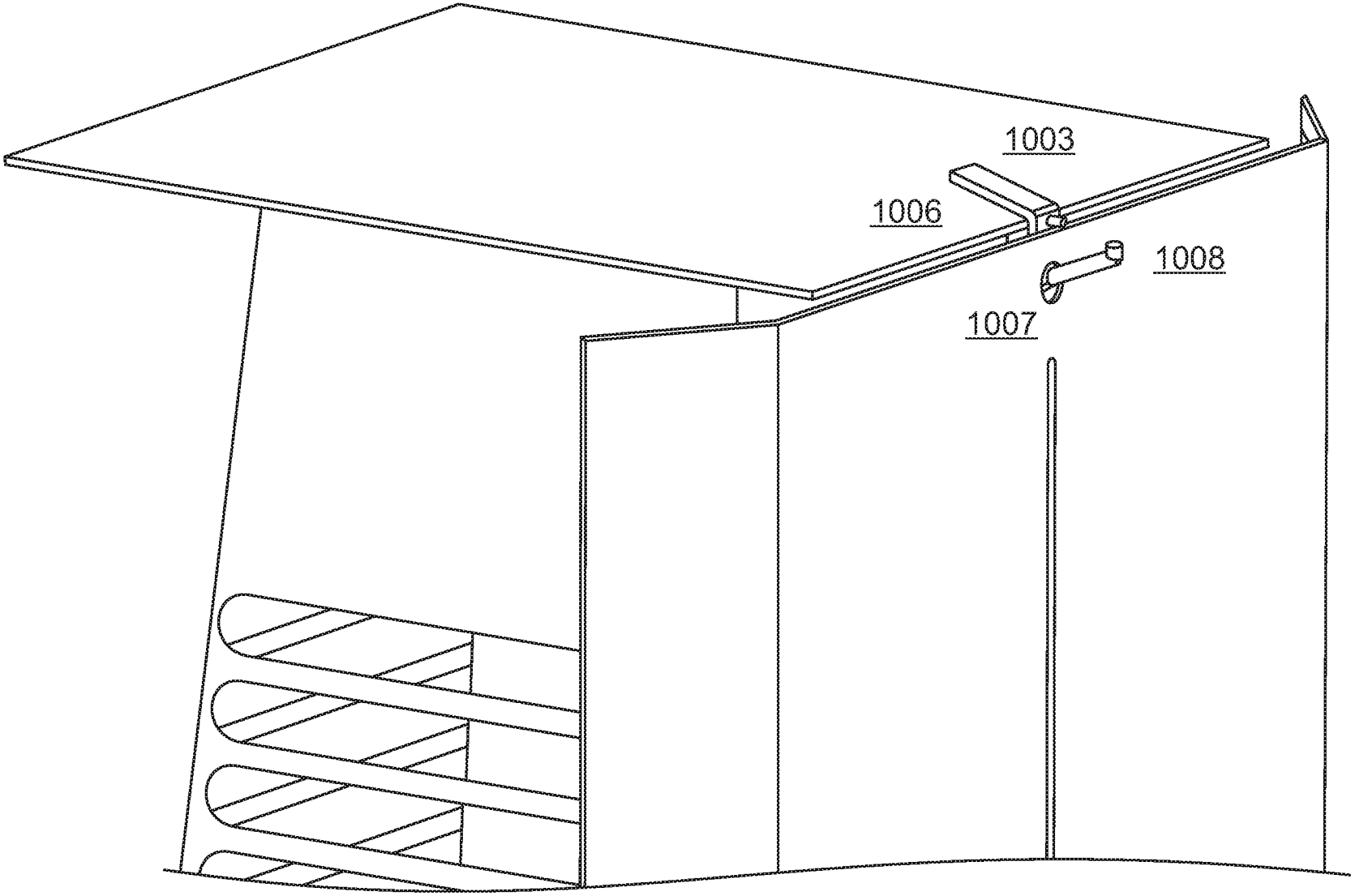
FIG. 12 is a view of the fastener 1003 of the embodiment of FIG. 10.
Figure 13:
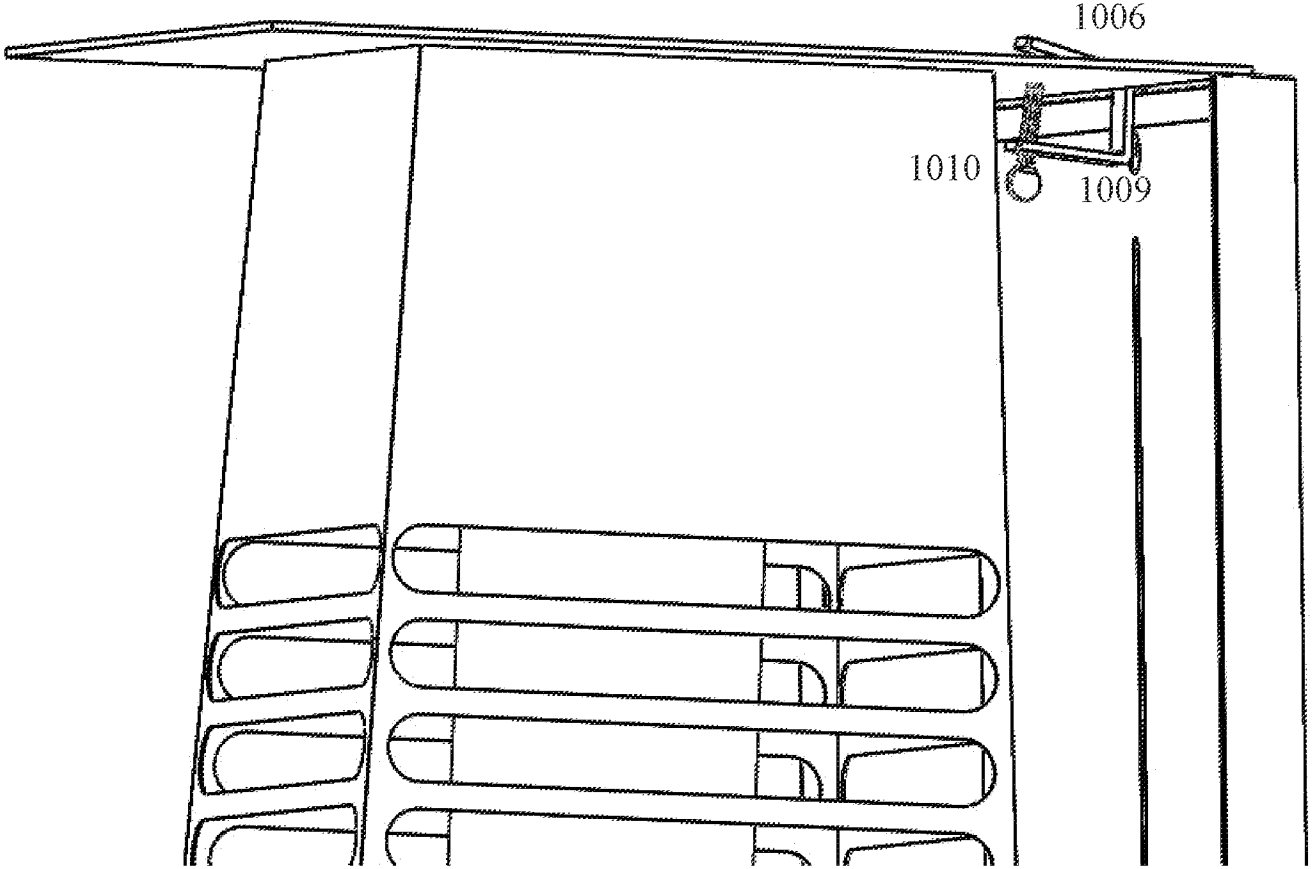
FIG. 13 is a bottom perspective view of the fastener 1003 of FIG. 12.

The fastener 1003 is shown in more detail in FIG. 12. The fastener 1003 has an upper member 1006 that extends onto the heater cap 104. A rear protruding member 1008 extends through a hole 1007 in panel 1001 to retain the panel in place. Referring now to FIG. 13, a bottom perspective view of fastener 1003 is shown. The fastener 1003 is a C or D clamp shape 1009 with a set screw 1010 that can be tightened onto the cap 104 to hold the fastener in place. The panel 1001 can then be placed on the member 1008 to direct heat as desired. The versatility of the fastener 1003 allows it to be placed nearly anywhere on the cap 104.

Figure 14:
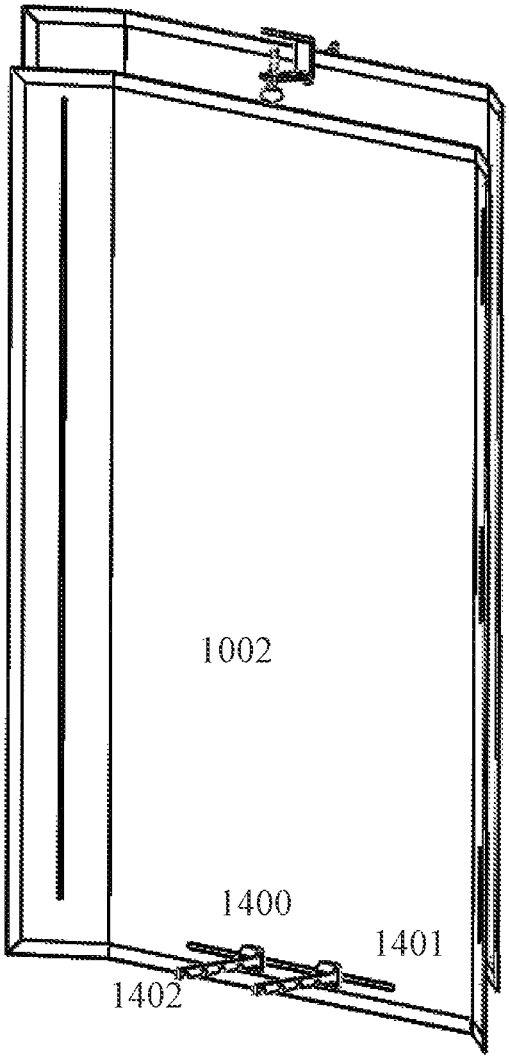
FIG. 14 illustrates a mechanism to hold the bottom of the reflector panels in place on a heater.
Figure 15:
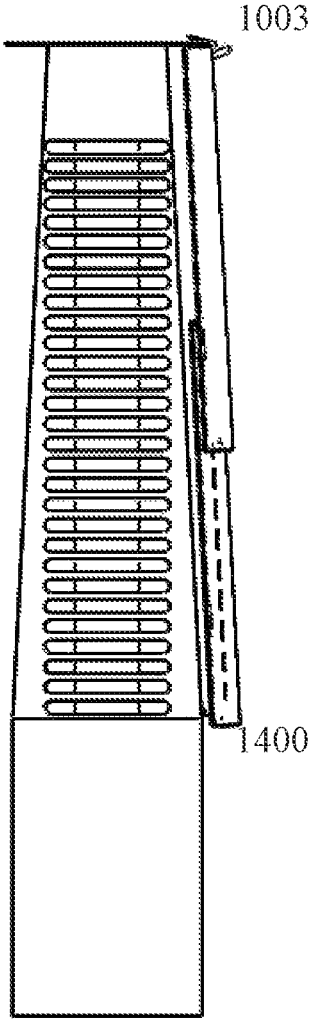
FIG. 15 illustrates the top and bottom fastening mechanisms in use.

FIG. 14 illustrates a bottom fastener 1400 to provide stability and a three-point connection to the reflector panels 1001 and 1002. The bottom fastener 1400 comprises two notched members 1402 slidably mounted in slot 1401. This permits customized lateral positioning of the bottom fastener. FIG. 15 illustrates the top and bottom fasteners in operation. The top fastener 1003 in one embodiment provides a single point of connection between the top of the panels and the heater. The bottom fastener 1400 provides two points of connection between the bottom of the panels and the heater.

Figure 16:
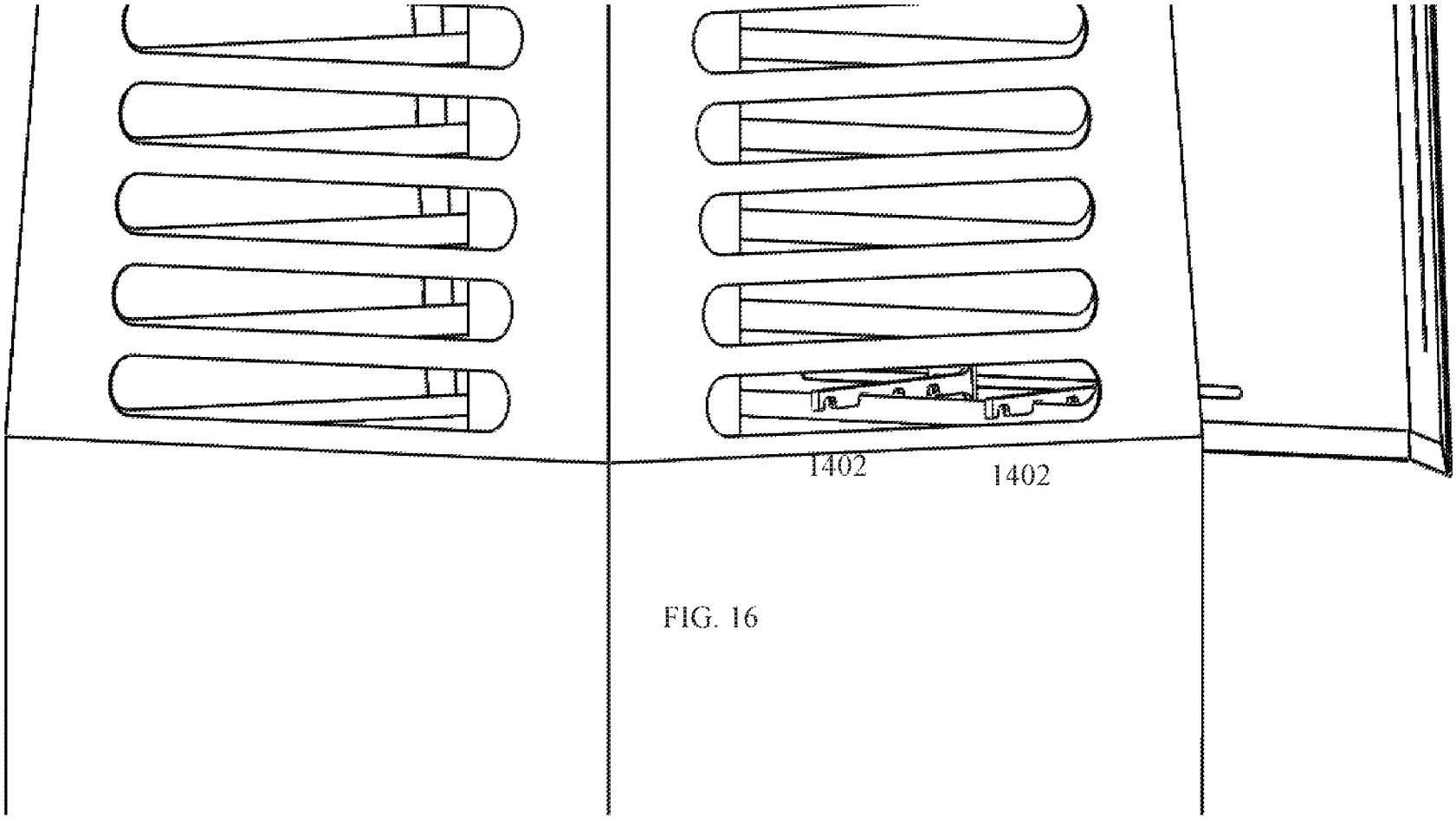
FIG. 16 illustrates a bottom perspective front view of the lower fastener in an embodiment.
Figure 17:
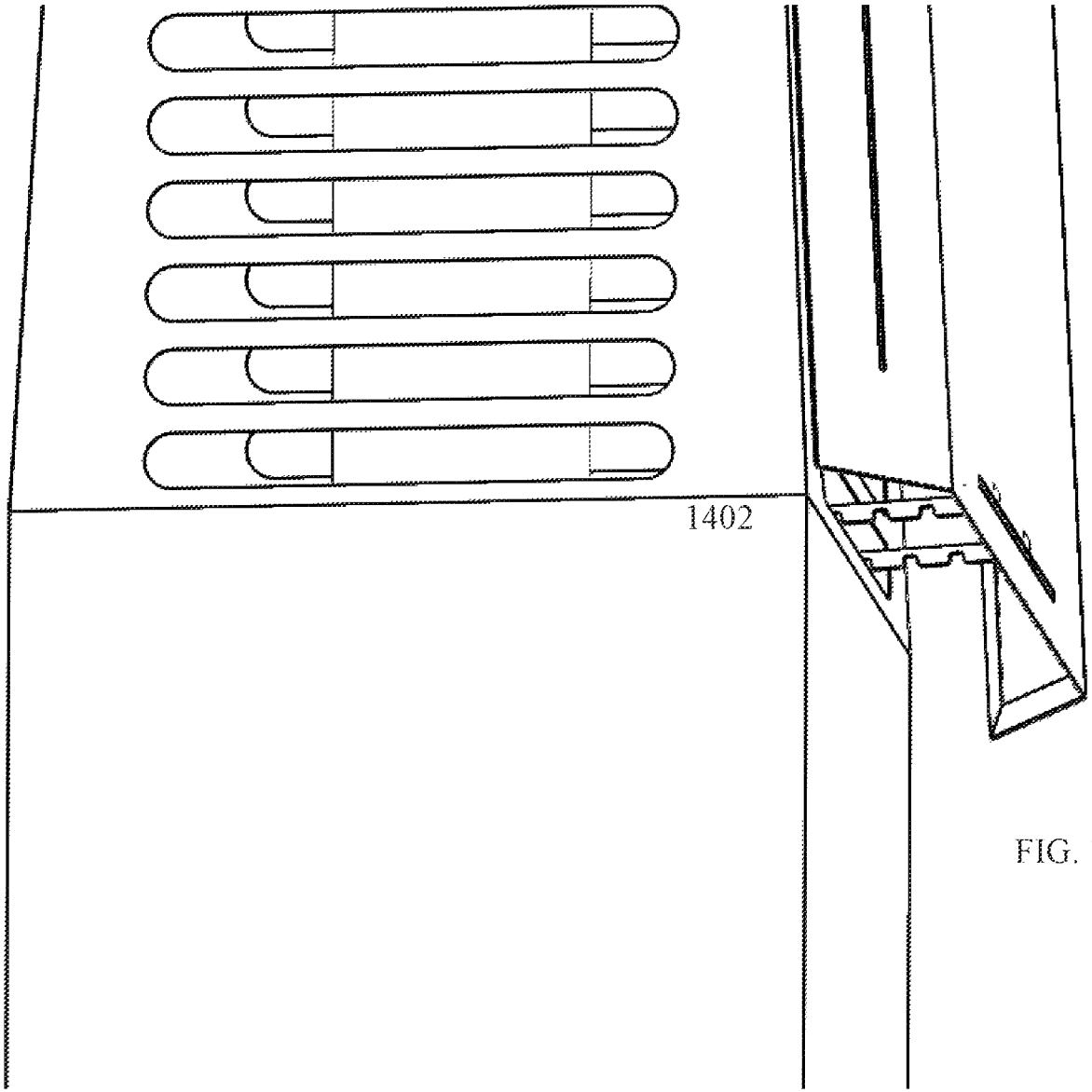
FIG. 17 illustrates a bottom perspective rear view of the lower fastener in an embodiment.

As seen in FIG. 16, the notched members 1402 can be engaged with the ribs of the heater housing and thereby hold the bottom of the panels in place. The three-point connection is more stable than a one or two point connection. The plurality of notches allows the panels to be placed closer to, or further from, the heater. FIG. 17 shows a rear view of the bottom fastener in operation.

Figure 18:
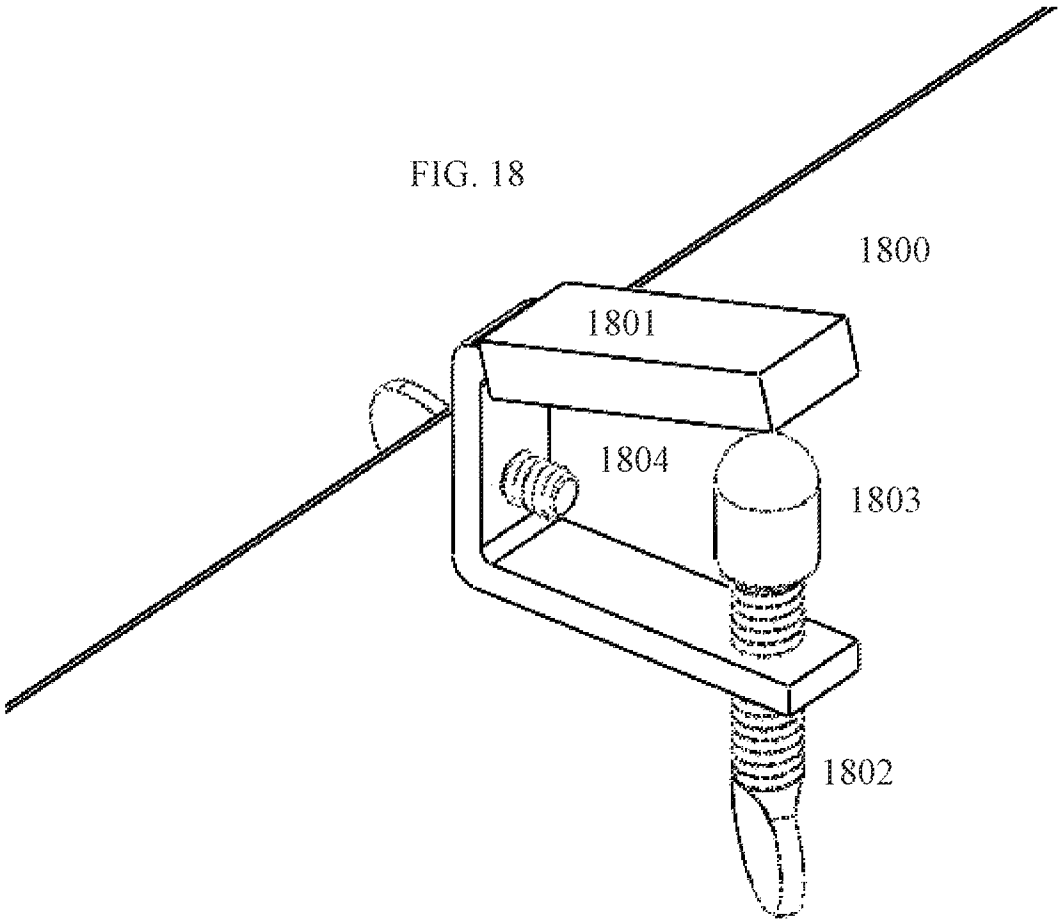
FIG. 18 illustrates an alternate upper fastener.

FIG. 18 illustrates an alternative fastener 1800 for use with the apparatus. The fastener includes a C or D shaped member for extending over a heater cover or other point of attachment. A thumb screw 1802 extends through a hole in the end of one of the legs of member 1801 to secure the fastener to the heater. A rounded cap 1803 is optionally provided to prevent damage to the heater. The cap may be pliant to provide additional friction to help hold the fastener in place. A rear thumbscrew 1804 is used to couple the fastener to a reflective panel.

Figure 19:
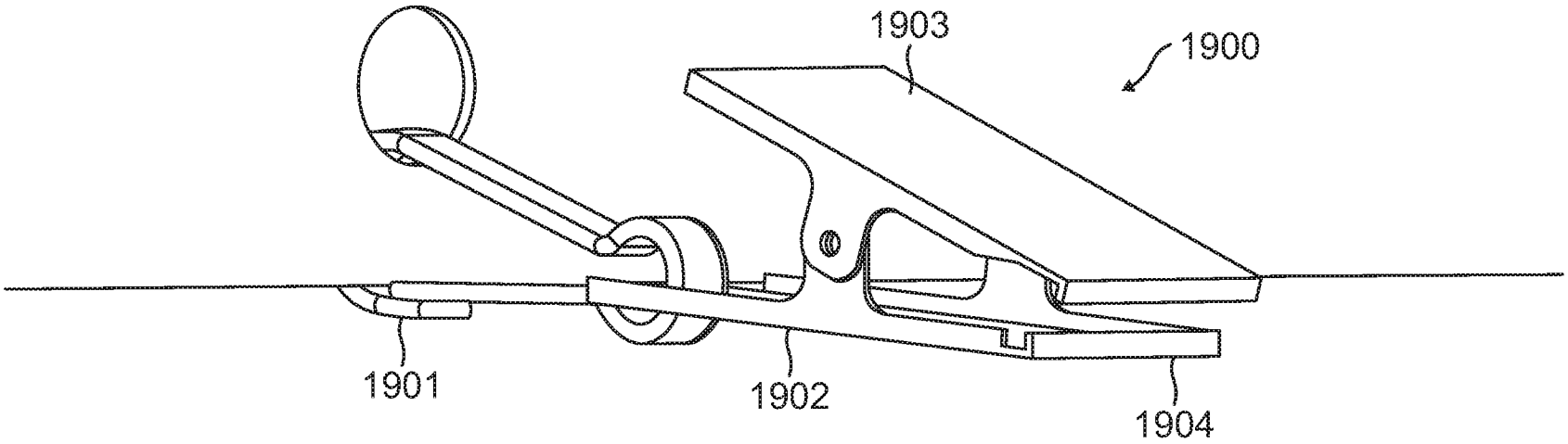
FIG. 19 illustrates a clip fastener for use in an embodiment.
Figure 20:
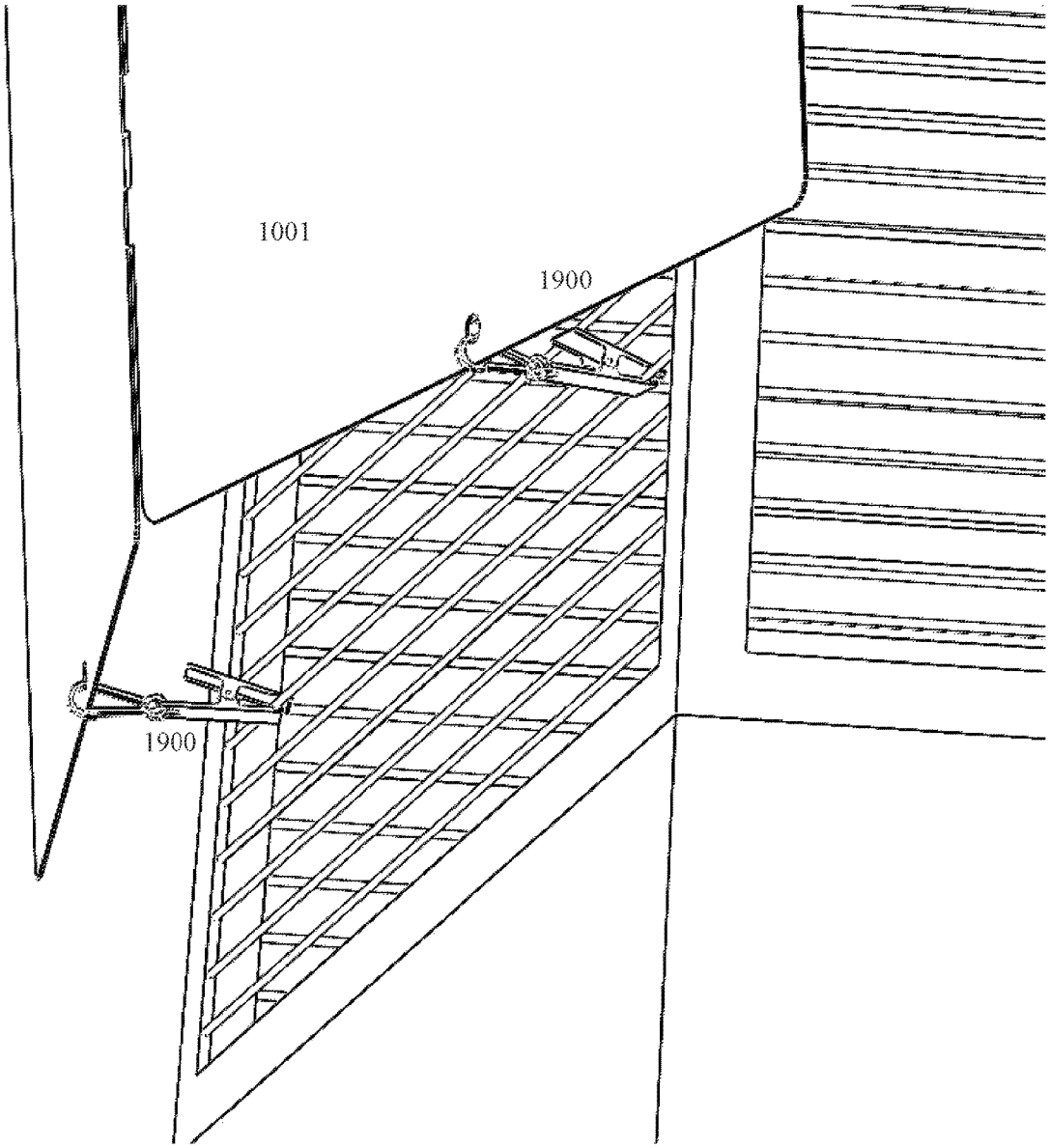
FIG. 20 illustrates the clip fastener in operation as a bottom fastener.
Figure 21:
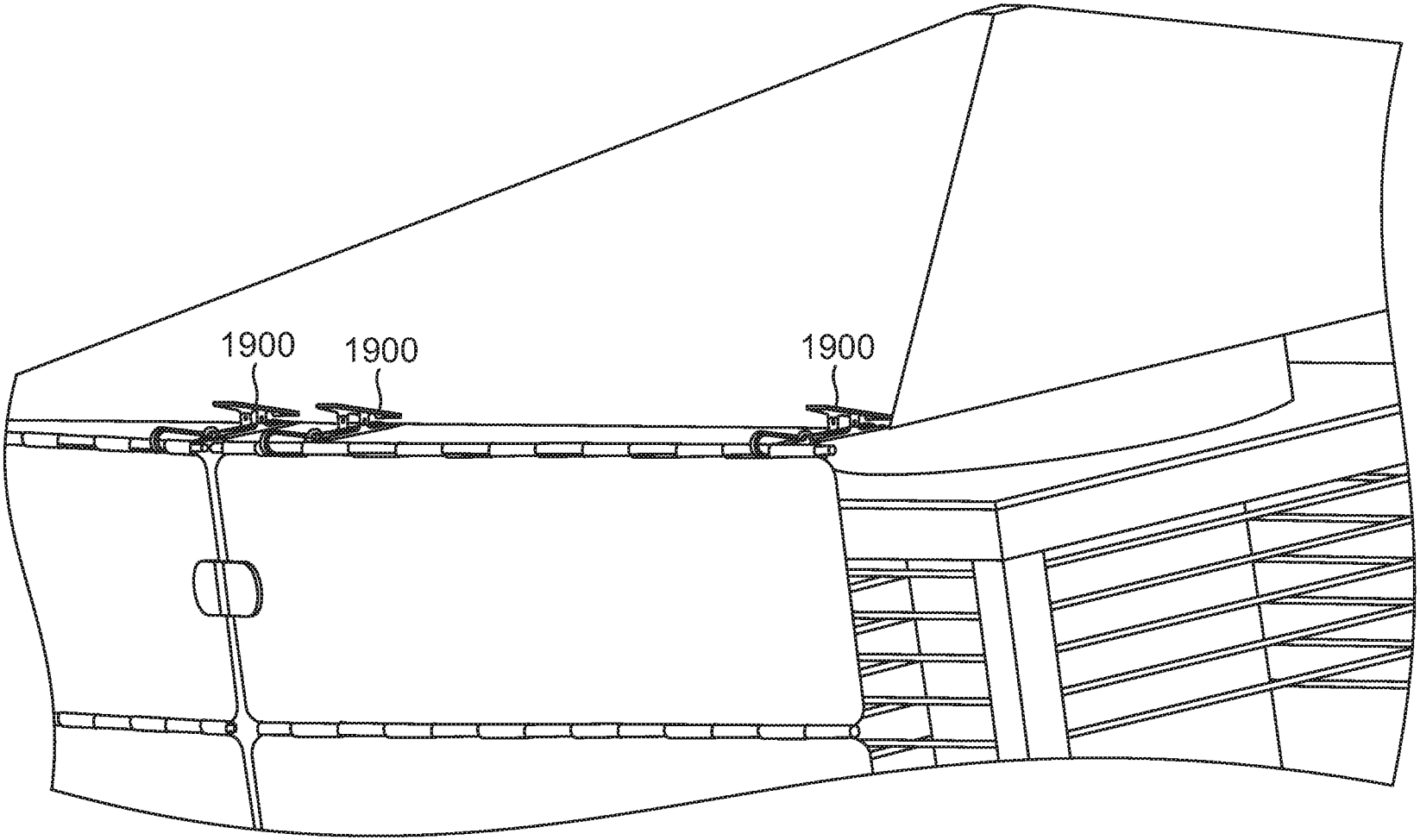
FIG. 21 illustrates the clip fastener in operation as a top fastener.

FIG. 19 illustrates an alternative fastener 1900 that may be used in an embodiment of the apparatus. Fastener 1900 is comprised of rear spring clip 1901 and front alligator clip 1902. The rear spring clip 1901 is used to attach clip 1900 to a reflector panel. The spring clip 1901 engages a bottom section 1904 of alligator clip 1902. The alligator clip includes a pivoting and spring biased upper member 1903 that can be compressed to widen the gripping section of the alligator clip 1902 to engage a surface, protrusion, rib, wire, or other area of a heater to hold the panel in place. FIG. 20 shows clips 1900 in use holding the bottom of panels 1001 to wires on a heater. The clips 1900 can move freely to attach at multiple points on a heater. FIG. 21 shows the clips 1900 holding the tops of reflector panels to the cap of a heater.

Figure 22:
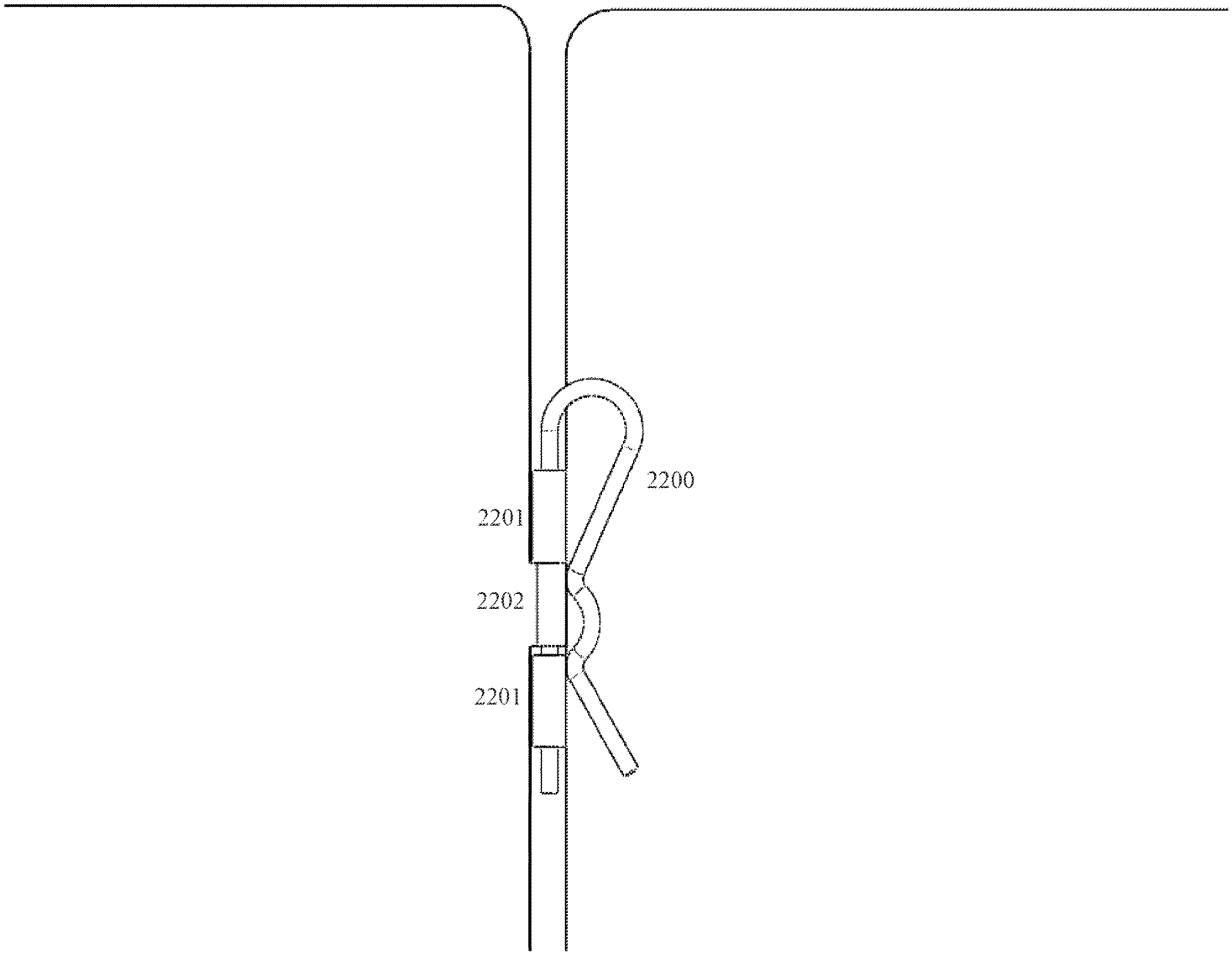
FIG. 22 illustrates a cotter pin fastener in an embodiment of the apparatus.

FIG. 22 illustrates the user of a cotter pin 2200 to secure a hinge region of two reflector panels. One panel has upper and lower open tubes 2201 and the other panel has at least one open tube 2202 to dispose between tubes 2201. The cotter pin 2200 has a straight member that is inserted into the hinge tubes, and a biased curved member holds the pin 2200 in place during use.

Figure 23:
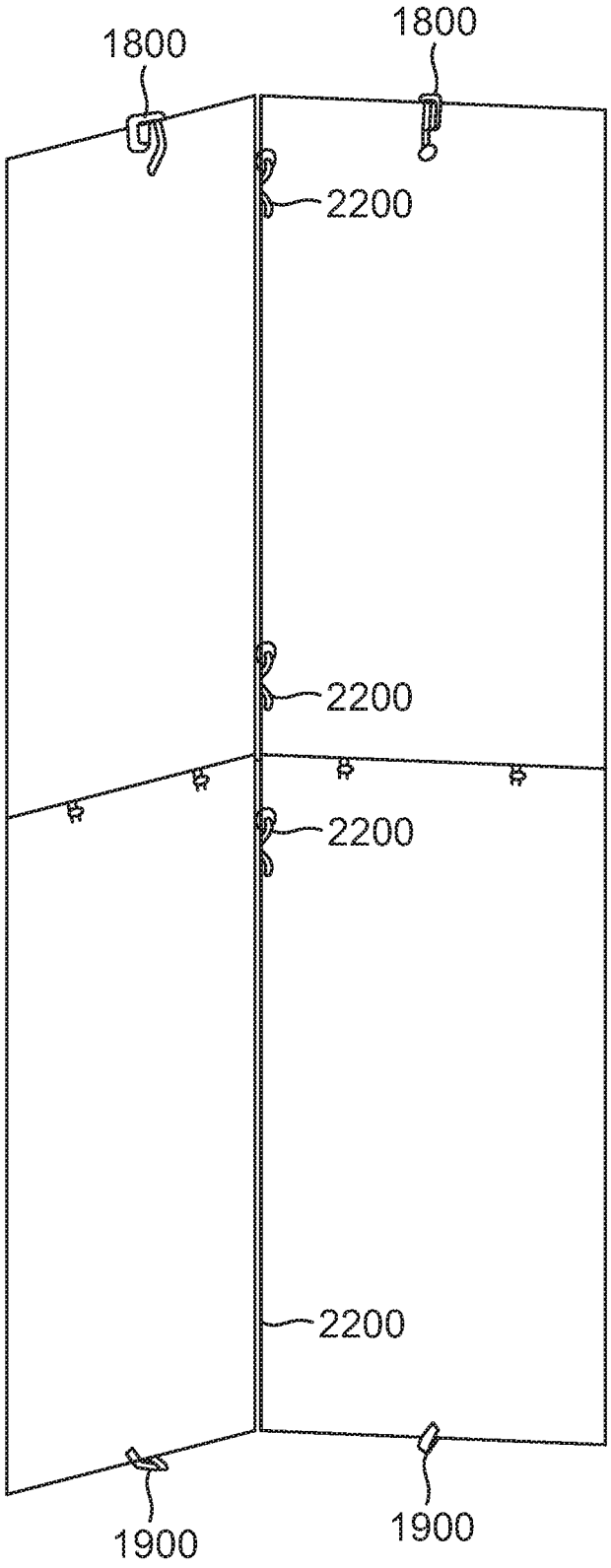
FIG. 23 is an embodiment of a four-panel assembly.

FIG. 23 shows a four-panel embodiment of a reflector configuration, with clamps 1800 at the top of the panels, cotter pins 2200 to hold the panels hingedly together, and clips 1900 to attach the bottom of the panel configuration to a heater.

Figure 24:
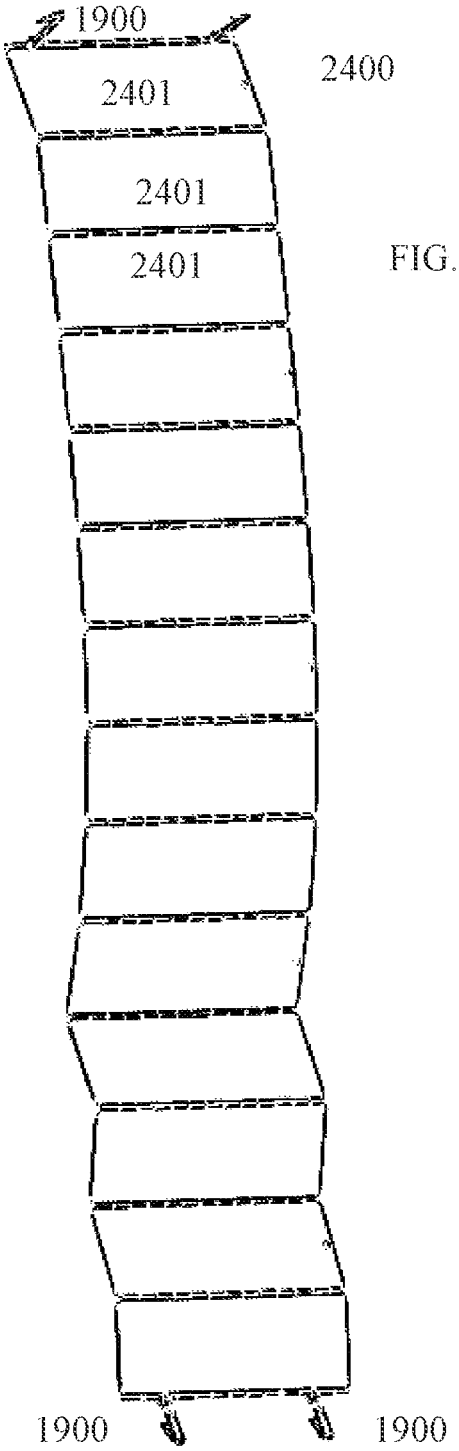
FIG. 24 is a multi-panel embodiment.

In one embodiment as shown in FIG. 24, the reflector assembly 2400 is comprised of multiple smaller reflector panels 2401, each hingedly joined to the next panel 2401, with the top and bottom panel including one or more fasteners (e.g., clips 1900) to attach the assembly 2400 to a heater to reflect heat in a directional manner.

Figure 25:
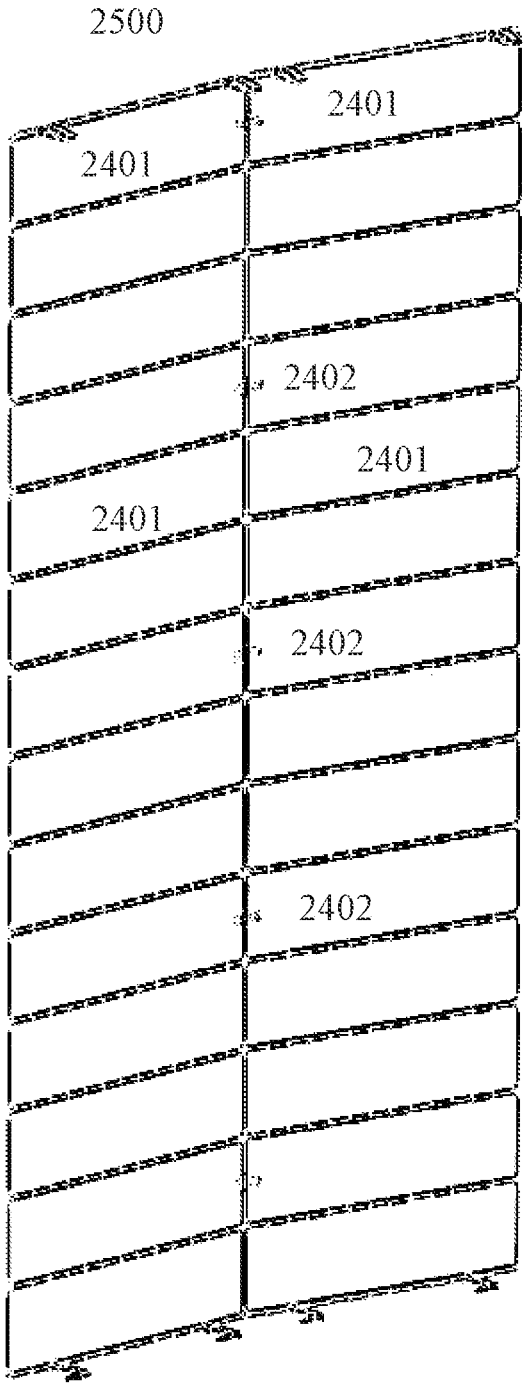
FIG. 25 illustrates the joining of two multi-panel configurations.

Two or more reflector assemblies 2400 can be joined together to form a larger assembly 2500 as shown in FIG. 25. Each assembly 2400 can be coupled to another assembly at one or more locations, such as locations 2402 shown in FIG. 25. There may be openings pre-formed some of the panels 2401 so that a fastener can be used to couple the assemblies together.

Figure 26:
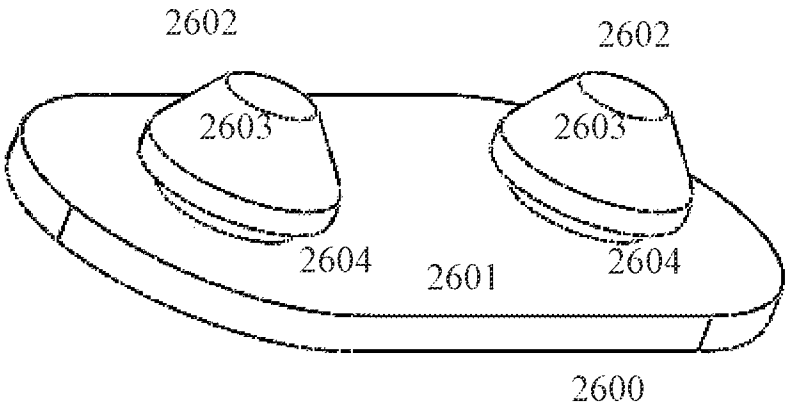
FIG. 26 illustrates an embodiment of a hinge fastener.
Figure 27:
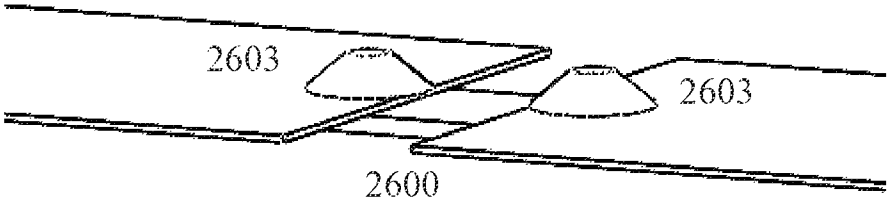
FIG. 27 illustrates the hinge fastener in operation.
Figure 28:
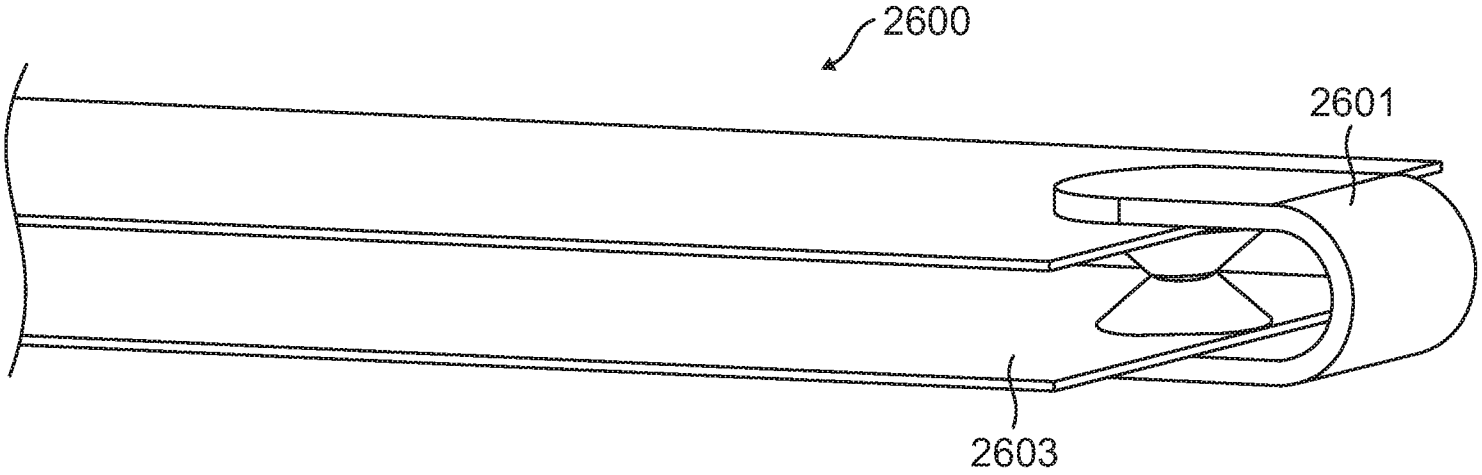
FIG. 28 illustrates the hinge fastener in a folded position.

A fastener 2600 for joining two panels together is illustrated in FIG. 26. The fastener 2600 comprises a base 2601 and two or more protruding members 2602. Each protruding member 2602 is comprised of a conical style cap 2603 disposed on a lower shaft 2604 that has a diameter smaller than that of the cap 2603. The fastener is made of a compressible material such as silicon, rubber, and the like. The members 2602 are inserted into an opening that has a smaller diameter than the largest portion of the cap 2603. The cap 2603 compresses as it is inserted into the opening and re-expands as it exits, holding the fastener securely in place. This is shown in FIG. 27 where the caps 2603 extend through openings in first and second panels. Once inserted, the flexible nature of base 2601 allows the fastener 2600 to act as a hinge, allowing full movement of the panels toward each other as shown in FIG. 28.

Figure 29:
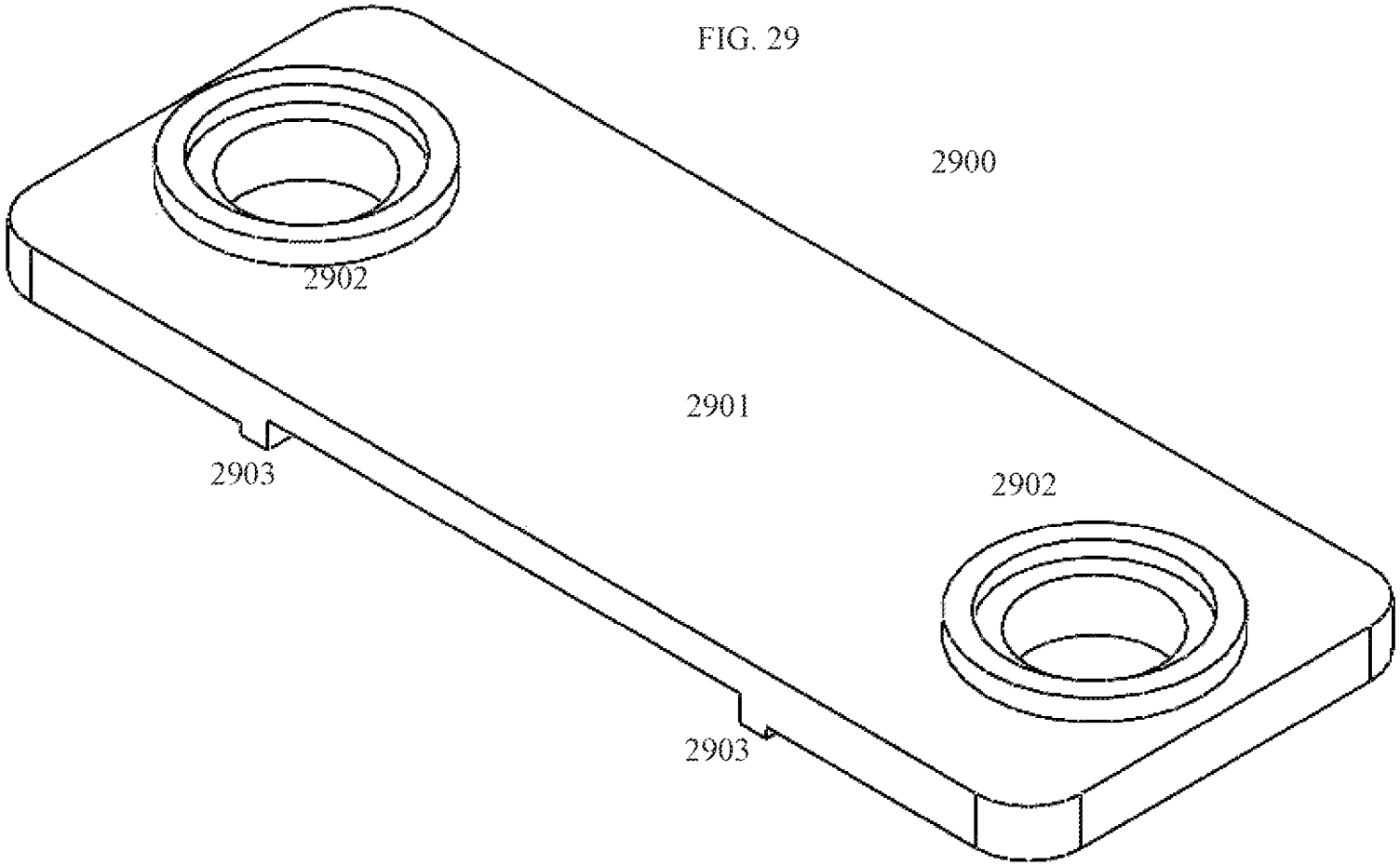
FIG. 29 illustrates an alternative hinge fastener.
Figure 30:
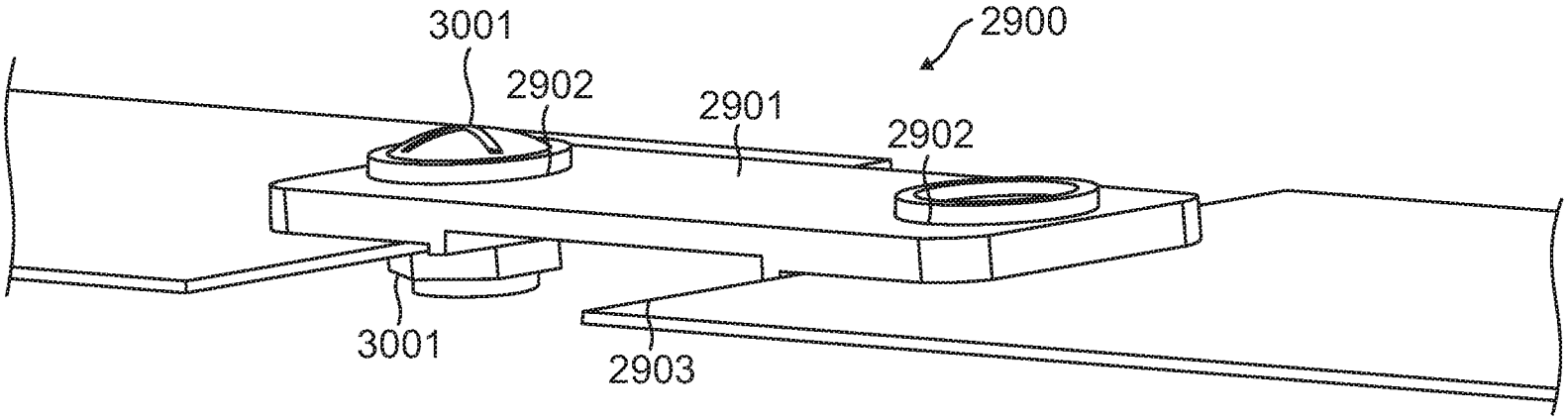
FIG. 30 illustrates the alternative hinge fastener in operation.

FIG. 29 illustrates an alternative fastener 2900 that can be used in an embodiment. The fastener 2900 has a base 2901 and two openings 2902 formed therein. The openings 2902 have a raised ring that extends above the surface of base 2901. The fastener 2900 can also include two regions 2903 that extend beyond the lower surface of base 2901. These regions 2903 can be used to position the fastener 2900 in a desired location on a panel to provide optimized operation of the fastener 2900. This is shown in FIG. 30 where regions 2903 abut the edge of two panels, registering the positioning of the fastener 2900. A bolt 3001 can be inserted through the opening 2902 in fastener 2900 and an opening in a panel, and then secured with a nut 3001 to hold the fastener in place. The fastener 2900 is made of flexible material that allows it to bend and act as a hinge, in a manner similar to that of fastener 2600.

Figure 31:
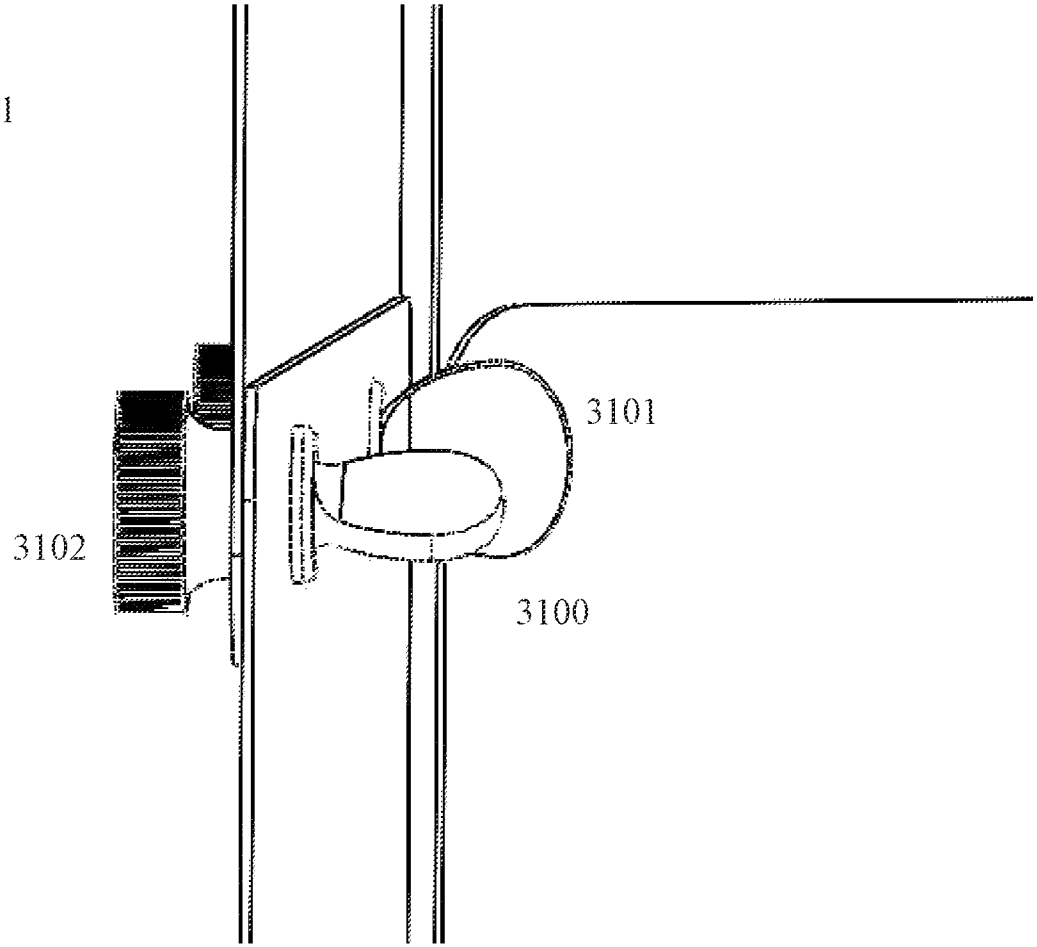
FIG. 31 illustrates a fastener to join reflector panels in an embodiment.

FIG. 31 illustrates an alternative fastener 3100 for use in an embodiment of the apparatus to connect two panels together. The fastener 3100 comprises a thumb screw 3101 and thumb nut 3102 that allows panels to be connected by hand, without the need for tools. In one embodiment, this fastener 3100 is used with the configuration of FIG. 23, but can be used with any embodiment.

Figure 32:
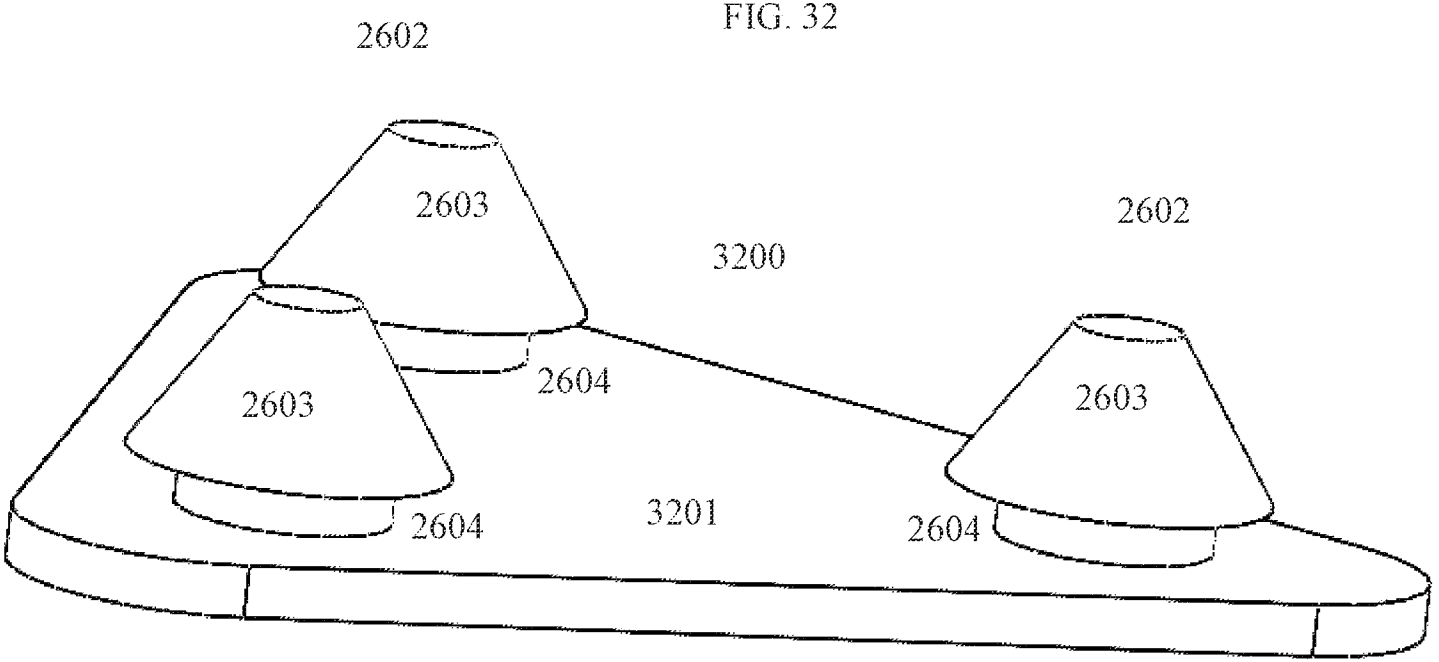
FIG. 32 illustrates an alternative version of the fastener of FIG. 26.

FIG. 32 illustrates an alternative configuration of the fastener of FIG. 26. Here the fastener 3200 has a triangular base 3201 on which there are three protruding members 2602, each comprising a conical member 2603 on a shorter shaft 2604. The shaft 2604 has a smaller diameter than the diameter of the base of the conical member 2603. The triangular shape provides more stability when joining panels and prevents or reduces relative motion between the panels.

Figure 33:
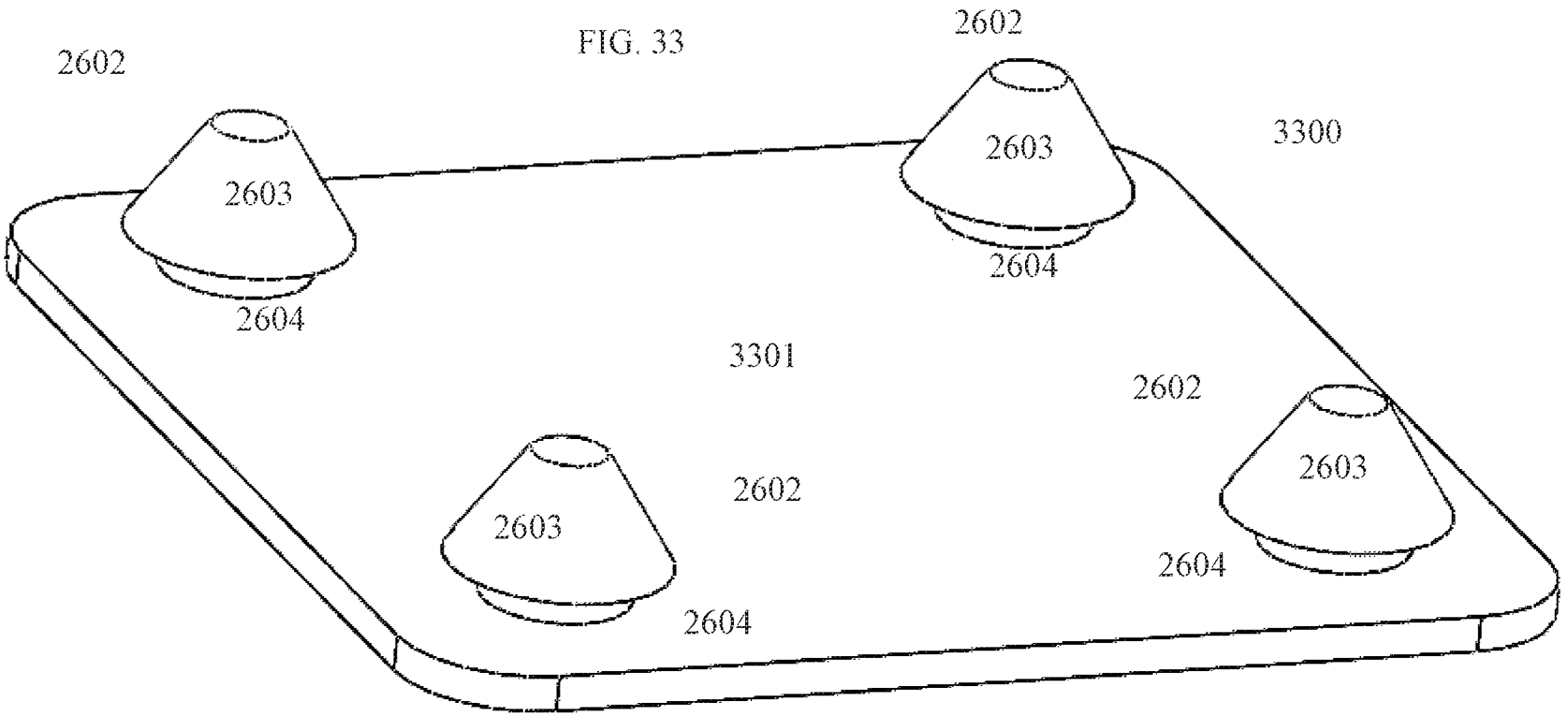
FIG. 33 illustrates an alternative version of the fastener of FIG. 26.

FIG. 33 illustrates an alternative configuration of the fastener of FIG. 26. Here the fastener 3300 has a rectangular base 3201 on which there are four protruding members 2602, each comprising a conical member 2603 on a shorter shaft 2604. The shaft 2604 has a smaller diameter than the diameter of the base of the conical member 2603. The rectangular shape provides more stability when joining panels and prevents or reduces relative motion between the panels.

It should be understood, of course, that the foregoing relates to exemplary embodiments of the apparatus and that modifications may be made without departing from the spirit and scope of the present apparatus. The present apparatus can be used on non-fire column patio heaters, such as electric heaters and the like.

What is claimed is:

1. A heater directional reflector comprising:

a first reflective member comprising a heat reflective material;

a second reflective member comprising a heat reflective material;

a first fastener for joining the first reflective member to the second reflective member;

a second fastener for coupling the first and second reflective members to an existing heater, wherein the existing heater is a columnar type heater having a pyramid shape with four sides and a cap, wherein the first and second reflective members are each of a size and shape to cover one of the four sides of the existing heater and to direct heat from the existing heater in a desired direction.

2. The heater directional reflector of claim 1 wherein the first reflective member is hingedly coupled to the second reflective member via the first fastener.

3. The heater directional reflector of claim 1 further including a plurality of reflective members that can be joined together to form a larger reflective member.

4. The heater directional reflector of claim 3 wherein the larger reflective member is of a size and shape to cover one of the four sides of the existing heater.

* * * * *